US007971459B2

(12) United States Patent
Price

(10) Patent No.: US 7,971,459 B2
(45) Date of Patent: Jul. 5, 2011

(54) DOOR LOCK AND ALARM

(75) Inventor: Mathew Price, Warwick (GB)

(73) Assignees: Bournemouth University, Poole (GB); Matthew Price, Warwick (GB)

( * ) Notice: Subject to any disclaimer, the term of this patent is extended or adjusted under 35 U.S.C. 154(b) by 0 days.

(21) Appl. No.: 12/305,855

(22) PCT Filed: Dec. 22, 2006

(86) PCT No.: PCT/GB2006/004911

§ 371 (c)(1),
(2), (4) Date: Jun. 9, 2009

(87) PCT Pub. No.: WO2008/001026

PCT Pub. Date: Jan. 3, 2008

(65) Prior Publication Data

US 2010/0236299 A1 Sep. 23, 2010

(30) Foreign Application Priority Data

Jun. 28, 2006 (GB) ..... 0612822.7

(51) Int. Cl.
*E05B 13/00* (2006.01)

(52) U.S. Cl. ..... 70/201; 70/209; 70/423; 70/427; 70/455; 70/DIG. 49; 70/DIG. 58

(58) Field of Classification Search ..... 70/14, DIG. 49, 70/423–428, 455, 209, 199, 200, 202, 203, 70/211, 212, DIG. 58, 166, 170, 333 A, 232; 292/288

See application file for complete search history.

(56) References Cited

U.S. PATENT DOCUMENTS

| | | | | | |
|---|---|---|---|---|---|
| 1,256,132 | A | * | 2/1918 | Hillburg | 70/202 |
| 1,338,945 | A | * | 5/1920 | Manley | 70/203 |
| 1,545,287 | A | * | 7/1925 | Stephenson | 70/193 |
| 2,578,547 | A | * | 12/1951 | Hilger | 74/566 |
| 3,952,564 | A | * | 4/1976 | Maines | 70/416 |
| 4,285,221 | A | * | 8/1981 | Atchisson | 70/416 |
| 4,570,470 | A | * | 2/1986 | Gray, Sr. | 70/428 |
| 4,578,970 | A | * | 4/1986 | Youngblood et al. | 70/428 |
| 4,798,069 | A | * | 1/1989 | DeForrest, Sr. | 70/428 |
| 4,899,564 | A | * | 2/1990 | Gilbert | 70/428 |
| 5,168,258 | A | | 12/1992 | Radke | |
| 5,201,202 | A | * | 4/1993 | Kam | 70/168 |
| 5,203,187 | A | * | 4/1993 | Kane | 70/455 |
| 5,425,256 | A | * | 6/1995 | Crosby | 70/209 |
| 5,560,235 | A | | 10/1996 | Aucoin | |
| 5,916,282 | A | * | 6/1999 | Elm et al. | 70/423 |
| 6,929,292 | B1 | * | 8/2005 | Galindo et al. | 292/288 |
| 2010/0199727 | A1 | * | 8/2010 | Varney et al. | 70/209 |

* cited by examiner

*Primary Examiner* — Lloyd A Gall
(74) *Attorney, Agent, or Firm* — Rankin, Hill & Clark LLP

(57) ABSTRACT

A door lock and alarm in the form of a case which is attached to the exterior door handle by a clamping mechanism that stops movement of the case with respect to the door in all degrees of freedom, but allows the handle to turn inside the case. The case is provided with a lockable cover so as to permit an authorized user to open the cover and operate the door handle. An alarm device can be provided within the case to indicate tampering with the door lock.

15 Claims, 4 Drawing Sheets

DOOR LOCK AND ALARM

The present invention relates to a method of locking and alarming doors, without damaging/modifying the door or anything associated to it. The invention has particular application to domestic interior doors.

BACKGROUND

In rented/short-term accommodation there are not often locks on internal doors (i.e. bedroom, bathroom/WC). Fitting an existing door lock would require modifying/damaging the door/doorframe.

The present invention provides an alarmed, lockable case that covers the door handle outside the door; preventing the door handle's operation and thus locking the door.

In use, the case attaches to the exterior door handle with a clamping mechanism that stops movement in all degrees of freedom, but allows the handle to turn inside the case. From inside the door, the door handle remains operational and does not hinder escape. The door handle, clamping mechanism and alarm are made inaccessible by closing and locking the lid of the case. They become accessible by unlocking and opening the lid, thus enabling the door, to be opened.

The invention comprises of three main components

1. The casing (covers the door handle, clamping mechanism and alarm)
2. The clamping mechanism (stops movement in all degrees of freedom)
3. The alarm (warns/scares intruders and alerts bystanders)

The main difference between this invention and other inventions is that it simply covers the door handle, but still allows it to turn inside the case, enabling it to be opened from the opposite side of the door.

The preferred embodiments has to be sold as kit that retrofits to existing door assemblies or, by way of example only, could be sold already attached to a door.

The invention could also be used inside the door, to prevent people getting out of a room, but allow people to get in.

DETAILED DESCRIPTION

To facilitate understanding of this invention a preferred embodiment will now be described by way of example, with reference to the accompanying drawings in which.

DESCRIPTION OF OPERATION

Figure 1:
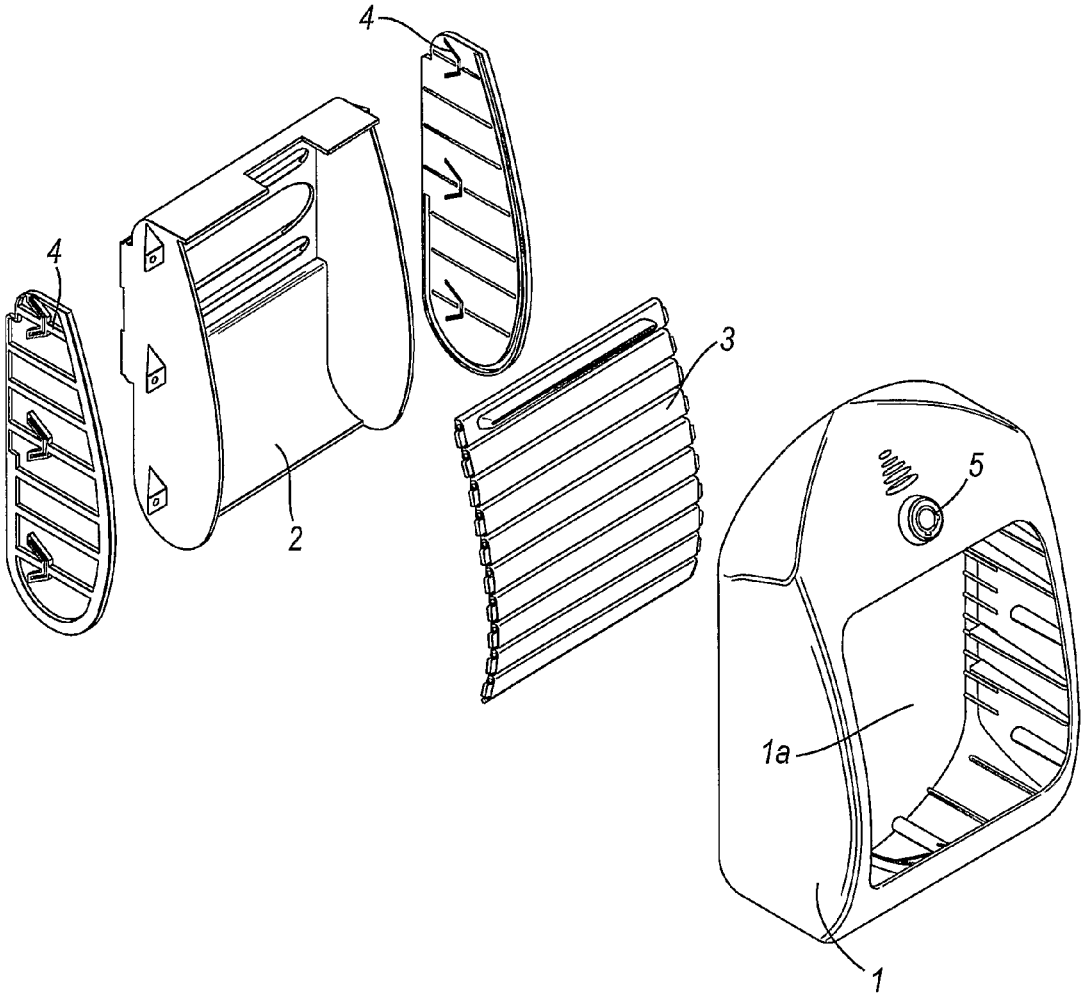
FIG. 1 shows an exploded isometric front view of the casing.
Figure 2:
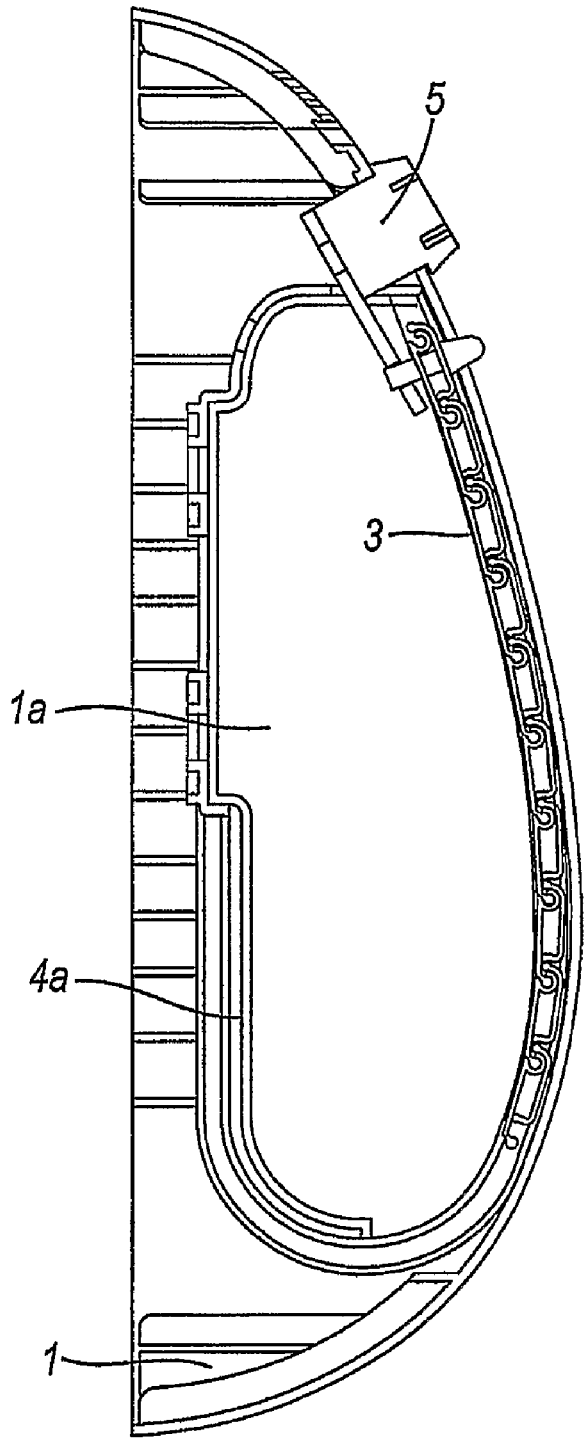
FIG. 2 shows a cross-sectional schematic side view of the casing shown in FIG. 1.
Figure 3:
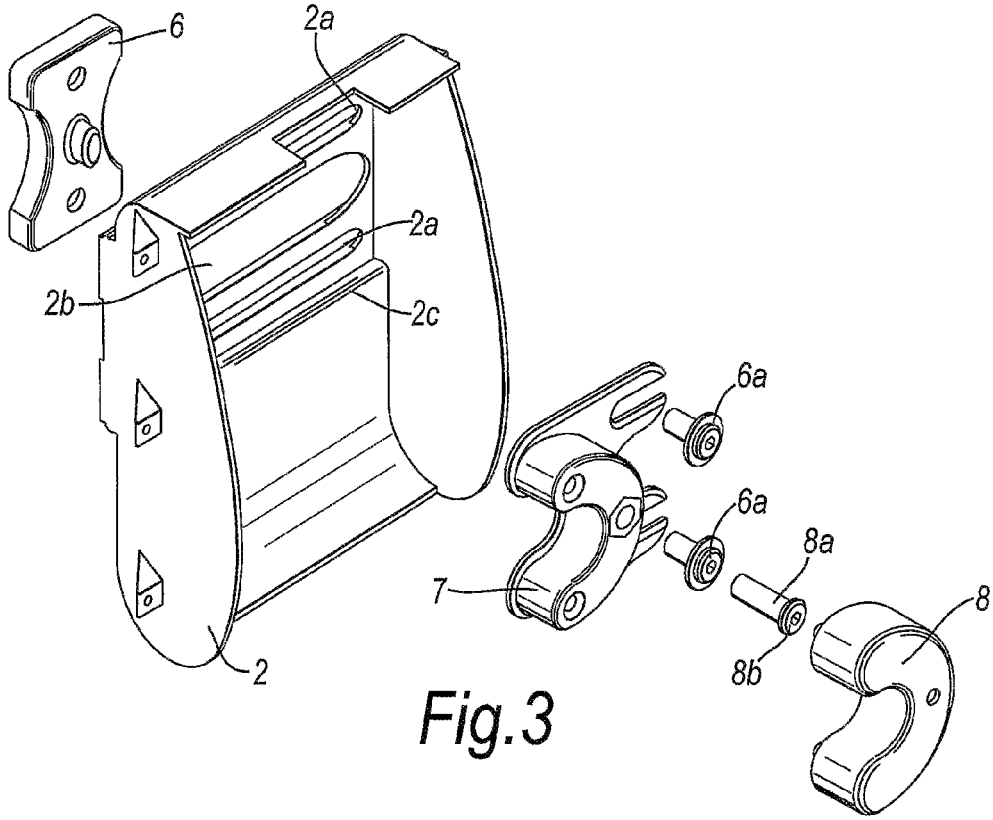
FIG. 3 shows an exploded isometric front view of the clamping mechanism in relation to the base.
Figure 5:
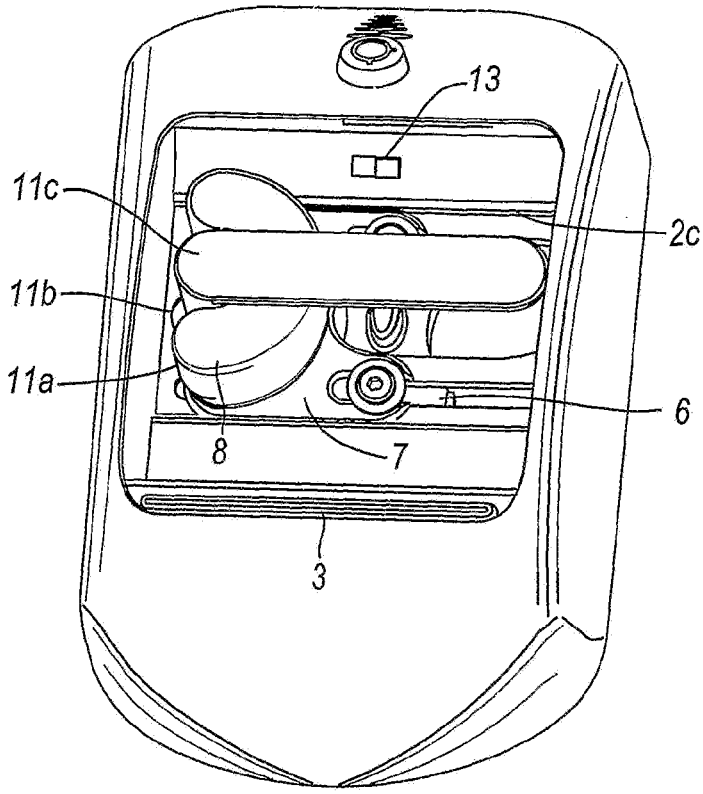
FIG. 5 shows the opened casing attached to a door handle (with clamping mechanism)

As shown in FIGS. 1-2, the casing consists of a case (1) that covers the entire door handle (as shown in FIG. 5), with an opening on the front face (1*a*) to permit access and operation of the door handle and clamping mechanism. A base (2) is securely fixed to the inside of the case (1), and holds the clamping mechanism (as shown in FIG. 3). The opening (1*a*) in the case (1) is closed by a moveable cover which can be locked in place. In the present embodiment, a sliding shutter 3 arranged to run in runners (4*a*) provided inside walls (4) of the case (1) is used to close the opening and is locked shut be a cam lock (5).

As shown in FIG. 3, the clamping mechanism consists of a handle-plate stop (6) (located behind the base (2)) that can be adjusted horizontally. The stop (6) slides in slits (2*a*) in the base (2) (parallel to and either side of a lever slot (2*b*)), then clamps to the base (2) with bolts (6*a*) that protrude through the slits (2*a*) from the stop (6).

A removable bracket (7) that when located in a channel (2*c*) in the base (2) can move horizontally then can be clamped to the base (2) again using the bolts (6*a*). A lever stop (8) is provided (attached to the bracket (7)) the extent of protrusion of which can be adjusted by a bolt (8*a*) in the bracket (7). It is 'C' shaped to allow the door handle to be turned even when the case is clamped to the handle.

Figure 4:
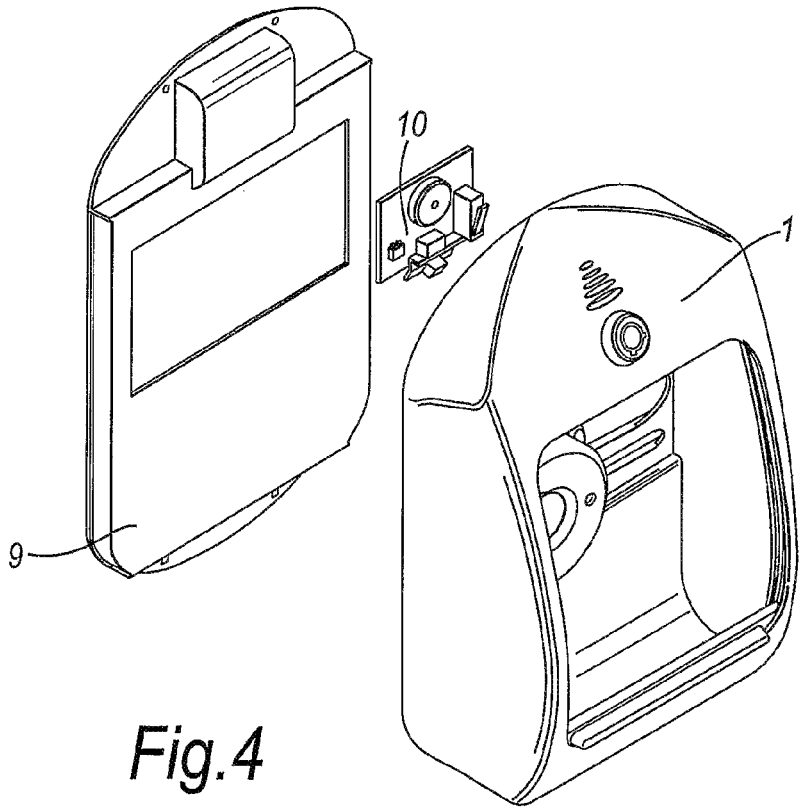
FIG. 4 shows an exploded isometric front view of the alarm and casing.

As shown in FIG. 4, the alarm consists of housing (9) that is fixed to the inside of the case (1) and contains the alarm's components (10) (and also shields the sliding lid mechanism). The PIC controlled alarm flashes an LED to warn it is armed, detects for vibration, flashes and sirens when vibration has been detected, then resets after a fixed time.

Attachment

As shown in FIG. 5 the sliding shutter (3) must be open and the bracket (7) removed. With the handle-plate stop (6) slid to the side furthest from the handle-plate (11*a*), the invention is attached to the door handle (11) by pushing the lever slot (2*b*) over the door lever (11*c*) until the case (1) is flush with the door (12), and the handle stem 11*b* in contact with an armature end of the slot (2*b*).

The bracket (7) is placed in the channel (2*c*), with the lever stop (8) on the same side of the bracket (7) as the handle-stem (11*b*). The bracket is slid up to the handle stem and the handle-plate stop is slid up to the handle plate. The bolts in the handle-plate stop are tightened (with an allen key) to clamp the bracket and the handle-plate stop on either side of the base. The lever stop is adjusted by turning the door lever to reveal the socket head in the bracket beneath the lever stop and tightening the bolt with an allen key.

Once fitted, the clamping mechanism (FIG. 3) need not be adjusted until the device is removed.

As shown by the Figures, daily use simply involves setting the alarm and locking the moveable cover when closing and disabling/unlocking when entering. With the shown described and the moveable cover is the open portion, the door handle can be grasped.

To Alarm/Lock

Using a switch (13) inside the case (1), the user determines whether the alarm (10) is to be set. The shutter (3) is simply slid shut to cover the door handle (11), clamping mechanism (FIG. 3) and alarm switch (13). It is then locked shut with the camlock 5, which also closes a micro-switch; arming the alarm (10) (if set).

To Disable the Alarm/Unlock

To open the shutter (3) the camlock (5) is unlocked, which also disarms the alarm (10). The shutter (3) is slid open to reveal the door handle (11), clamping mechanism (FIG. 3) and alarm switch (13). The shutter (3) slides into the case (1) (FIG. 2) and is concealed by the base (2) when open.

Removal

The sliding shutter (3) must be open. The lever stop (8) is loosened by turning the door lever (11*c*) (to reveal the socket head (8*b*) in the bracket underneath the lever stop (8)) and loosening the bolt (8*a*) (with an allen key). Once the lever stop (8) is moved one gains access to the bolts (6*a*) in the handle-plate stop (6) are loosened (with an allen key) to release the bracket (7) and the handle-plate stop (6). The handle-plate stop (6) is slid away from the handle-plate (11*a*) and the bracket (7) is removed. The invention is removed from the door handle (11) by pulling the lever slot (2*b*) over the door lever (11*c*). over the door lever (11*c*).

Stopping Movement of the Six Degrees of Freedom

As shown by FIG. 5, the handle is clamped between the handle-plate stop (6) and the ellipse shape (2*d*) of the lever slot. The handle-plate stop is held fast by tightening the bolts which frictionally clamp the bracket to the base, this prevents movement in the left/right degrees of freedom.

Figure 6:
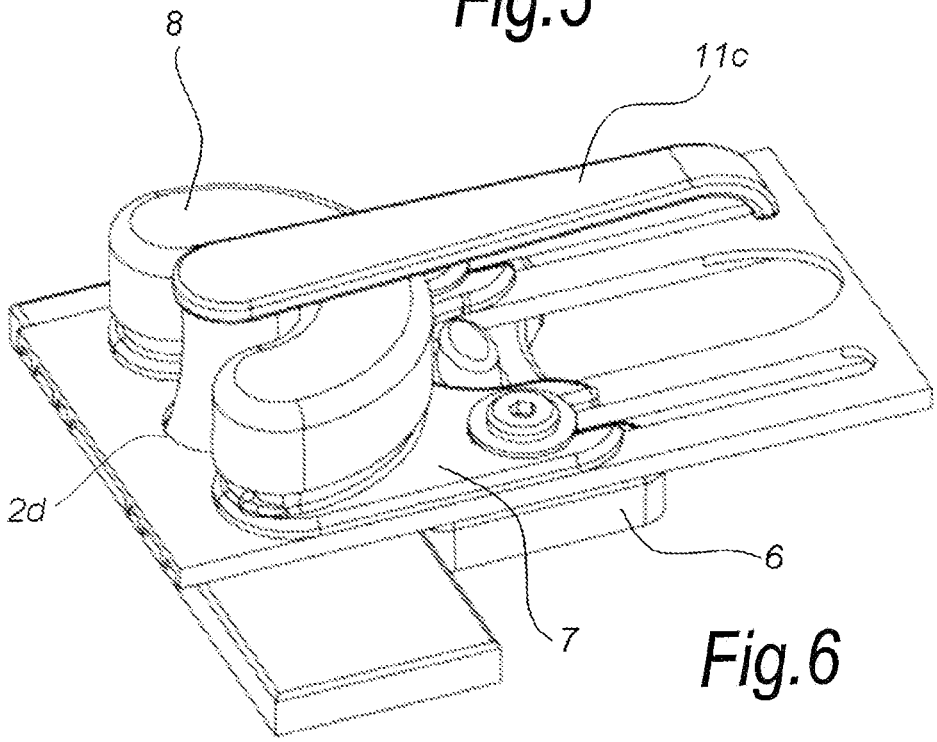
FIG. 6 shows the handle-plate stop clamping a handle-plate.

As shown by FIG. 6, the handle-stem 11*b* is clamped between the bracket and the ellipse shape end (2*d*) of the lever slot. The facing concave shapes are pushed together which mechanically prevents movement in the up/down degrees of freedom. The lever 11*c* of the handle is clamped by the lever-stop (8) (adjusted by a bolt) and the door itself. This mechanically prevents movement in the in/out degrees of freedom.

For door levers with circular roses, instead of rectangular handle-plates, the concave shape of the handle-plate stop (6) grips the periphery of the rose.

The clamping mechanism can adjust to fit different dimensions for lever-protrusion, handle-plate width/handle-stem diameter and left or right-swing doors. By way of example, the lever-stop 8 can be adjusted by say 15 mm, to fit door lever protrusions from 25 to 40 mm using the adjustable bolt 8*a*.

Various modifications may be made to the precise mechanism described above. For example, different covers can be used to replace the sliding shutter shown in the drawings. Further, instead of using bolts which require an allen key, a similar action can be achieved using finger screws of thumb wheels perhaps with the exception of the bolt 8*a* which is used to secure the lever stop 8. Further, shims and spacers may be provided in order to ensure close fitting between the lock and the door and between the lock and the door handle.

It will be appreciated that although a door fitted with a conventional lever handle is shown, the present invention can also be used with a simple knob handle in which case the bracket 7 and lever stop 8 would be located in the waiste portion of the knob handle.

The invention claimed is:

1. A door lock for attachment to a handle of a door, comprising a casing having a first opening in a first wall of the casing for receiving a handle of a door and arranged to envelop the handle and any associated escutcheon, the casing having a further opening in a second wall of the casing which is provided with a movable cover for permitting access to the interior of the casing, and being provided with a clamping mechanism for clamping the casing to the handle, the movable cover having a lock for locking so as to close the further opening, wherein the movable cover is operable independently of the clamping mechanism.

2. A door lock according to claim 1 wherein the first opening comprises a slot having an arcuate end for abutment with a stem of the door handle, and the clamping mechanism comprises a bracket moveable along the slot whereby to engage the stem of the door handle between the bracket and the arcuate end of the slot.

3. A door lock according to claim 2 wherein the bracket has an arcuate face arranged to contact the stem of the handle whereby to permit rotation of the handle when in position.

4. A door lock according to claim 2 wherein the bracket is provided with a lever stop located between the first wall of the casing and the handle for limiting movement of the casing away from the door.

5. A door lock according to claim 1 and comprising an alarm device for indicating tampering with the door lock.

6. A door lock according to claim 5 wherein the alarm device is armed and disarmed from within the casing.

7. A door lock according to claim 3 wherein the bracket is provided with a lever stop located between the first wall of the casing and the handle for limiting movement of the casing away from the door.

8. A door lock according to claim 7 and comprising an alarm device for indicating tampering with the door lock.

9. A door lock according to claim 8 wherein the alarm device is armed and disarmed from within the casing.

10. A door lock according to claim 2 and comprising an alarm device for indicating tampering with the door lock.

11. A door lock according to claim 10 wherein the alarm device is armed and disarmed from within the casing.

12. A door lock according to claim 3 and comprising an alarm device for indicating tampering with the door lock.

13. A door lock according to claim 12 wherein the alarm device is armed and disarmed from within the casing.

14. A door lock according to claim 4 and comprising an alarm device for indicating tampering with the door lock.

15. A door lock according to claim 14 wherein the alarm device is armed and disarmed from within the casing.

* * * * *